US008772613B2

(12) United States Patent
Gembar

(10) Patent No.: US 8,772,613 B2
(45) Date of Patent: Jul. 8, 2014

(54) GUITAR WITH DOUBLE CARVE SOUND BOARD

(75) Inventor: Richard Gembar, Mt. Juliet, TN (US)

(73) Assignee: Gibson Brands, Inc., Nashville, TN (US)

( * ) Notice: Subject to any disclaimer, the term of this patent is extended or adjusted under 35 U.S.C. 154(b) by 368 days.

(21) Appl. No.: 12/661,328

(22) Filed: Mar. 15, 2010

(65) Prior Publication Data

US 2011/0219932 A1 Sep. 15, 2011

(51) Int. Cl.
*G10D 3/00* (2006.01)

(52) U.S. Cl.
USPC ..... 84/291; 84/267

(58) Field of Classification Search
USPC ..... 84/267, 290, 291, 293, 294
See application file for complete search history.

(56) References Cited

U.S. PATENT DOCUMENTS

| | | | | |
|---|---|---|---|---|
| 2,414,238 | A | 1/1947 | Osburn | |
| 4,016,793 | A | 4/1977 | Kasha | |
| 4,362,079 | A | 12/1982 | Kelly | |
| 4,467,692 | A | 8/1984 | Egan | |
| 5,661,252 | A | 8/1997 | Krawczak | |
| 5,747,711 | A * | 5/1998 | Cavaness et al. | 84/291 |
| 6,114,616 | A | 9/2000 | Naylor | |
| 6,459,024 | B1 | 10/2002 | Baker | |
| 6,664,452 | B1 | 12/2003 | Teel | |
| 6,689,943 | B2 | 2/2004 | McGuire, Jr. et al. | |
| 6,696,627 | B2 | 2/2004 | Florath et al. | |
| 6,833,501 | B2 | 12/2004 | Jagmin | |
| 7,151,210 | B2 | 12/2006 | Janes et al. | |
| 7,164,072 | B2 | 1/2007 | Park | |
| 7,208,664 | B1 * | 4/2007 | Regenberg et al. | 84/267 |
| 7,514,615 | B2 | 4/2009 | Ribbecke | |
| 2005/0150346 | A1 * | 7/2005 | Wyman | 84/291 |
| 2011/0005366 | A1 * | 1/2011 | Gillett | 84/298 |

* cited by examiner

*Primary Examiner* — Kimberly Lockett
(74) *Attorney, Agent, or Firm* — Bates & Bates, LLC

(57) ABSTRACT

A stringed musical instrument body with a front plate having an integral cavity defined by a tail end inner edge, a neck end inner edge, a bass side inner edge, and a treble side inner edge is provided. The cavity cooperates with a back plate to form a resonance chamber. A method for making the stringed musical instrument body is also presented. In many instances, the stringed musical instrument is a guitar.

18 Claims, 6 Drawing Sheets

GUITAR WITH DOUBLE CARVE SOUND BOARD

TECHNICAL FIELD

The field of the disclosure relates generally to the construction of stringed musical instruments. More particularly, the disclosure relates to the construction of guitar bodies with double carved sound boards.

BACKGROUND

A traditional hollow body acoustic guitar is a contrast to a solid body electric guitar. In the electric guitar, sound is primarily a function of the string vibration versus the hollow body of the acoustic guitar which acts as a sound chamber to generate acoustical energy. Many musicians prefer the sound of an acoustic guitar; however, one drawback of traditional acoustic guitars is the low volume of sound produced by the guitar, making it difficult to play an acoustic guitar for a large audience. Retrofitting acoustic guitars with electronic pick-ups increases the volume of sound but may have negative consequences such as weakening the guitar and feedback effects caused by inconsistent amplification of the tones.

Semi-hollow body guitars, which utilize conventional electronic guitar pick-ups on a body that is typically thinner than a conventional acoustic guitar, but which still contain a marginally hollow core have addressed some of the problems with electrifying hollow body guitars. Current semi-hollow body guitars, also known as semi-acoustic guitars, have a solid wooden block running down the center of the guitar or chambered backs, which can help with feedback problems and strengthen the general body of the guitar. And although current semi-hollow body guitars have addressed some of the problems involved in providing amplified acoustical sound, there is a continuing need to improve on semi-hollow body guitars in order to obtain the desired amplified acoustical sound.

SUMMARY

In one aspect, the present disclosure is directed toward a body of a stringed musical instrument having an internal resonance chamber formed by a front plate and back plate where the front plate has an integral internal cavity. In many embodiments, the stringed musical instrument is a guitar and the integral internal cavity has an inverted horseshoe shape.

The integral cavity provides for a resonance chamber with different overall depths and shapes resulting in a wide variety of different sounds. In many exemplary embodiments, a bridge support extends into the cavity. The bridge support strengthens the front plate for attachment of the bridge. A stringed musical instrument with the disclosed body is further envisioned.

Consistent with a further aspect of the disclosure, a method is provided for making the body of the stringed musical instrument.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Figure 1:
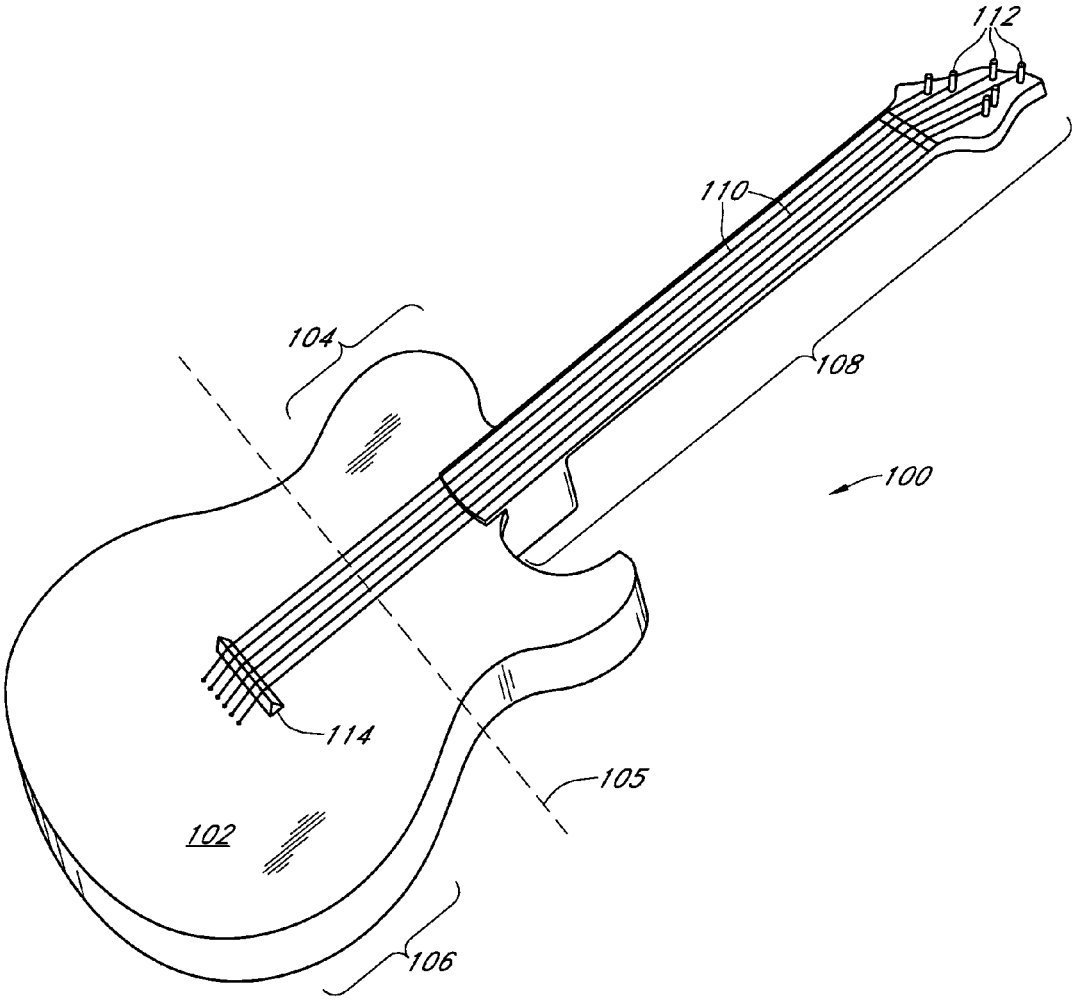
FIG. 1 depicts a front elevational view of a stringed musical instrument.

Exemplary embodiments of the stringed musical instrument will now be explained with reference to the figures. This description is provided in order to assist in the understanding of the invention and is not intended to limit the scope of the invention to the embodiments shown in the figures or described below. FIG. 1 demonstrates the top view of a stringed instrument body. In the embodiment of FIG. 1, the stringed instrument is a guitar. However, the components and advantages currently disclosed are applicable to other types of stringed instruments, such as bass guitars, ukuleles, mandolins, violins or classical lutes. Referring now to FIG. 1, body 100 comprises a front plate 102, with a neck end 104 and a tail end 106. In many instances, front plate 102 is synonymous with a stringed musical instrument soundboard. A center axis 105 separates neck end 104 from tail end 106. The stringed musical instrument also includes a neck 108 and at least one string 110 attached to and extending from neck 108 to body 100. At least one peg 112 rotatably supported in the head of neck 108 attaches one end of strings 110 to neck 108. The opposite end of strings 110 extend over a bridge 114 and are fastened with front plate 102 of body 100. There are many known ways of fastening strings 110 to body 100.

Figure 2:
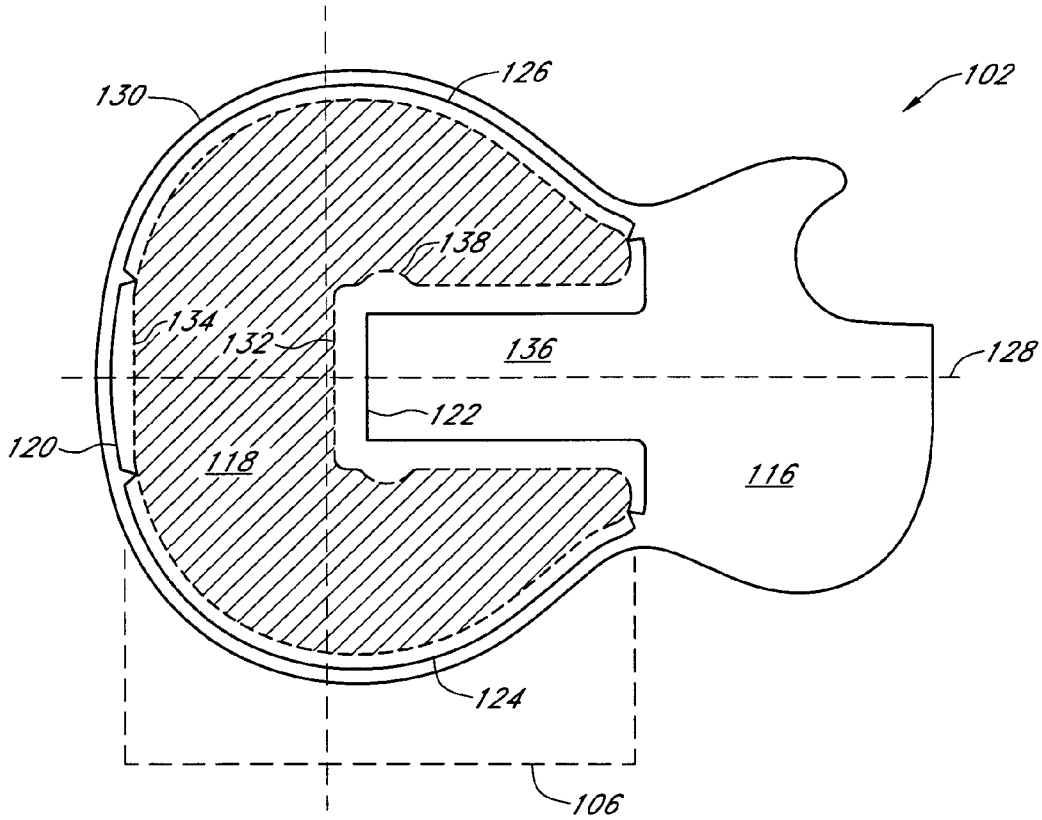
FIG. 2 illustrates the interior of the front plate.

FIG. 2 shows the detail of interior 116 of front plate 102. As can been seen from the figure, the interior 116 of front plate 102 has a cavity 118. Cavity 118 is defined by a tail end inner edge 120, a neck end inner edge 122, a bass side inner edge 124, and a treble side inner edge 126. Generally, when tail end 106 of the stringed musical instrument is symmetrical around longitudinal axis 128, cavity 118 will also be symmetrical around longitudinal axis 128, although there is no requirement that this be true. In many embodiments, the shape of bass side inner edge 124 and treble side inner edge 126 substantially follow the shape of tail end 106. Tail end inner edge 120 may be flat, such as that shown in FIG. 2. Tail end inner edge 120 may also be curved such that tail end inner edge 120, bass side inner edge 124 and treble side inner edge 126 all substantially follow the shape of tail end 106.

Tail end inner edge 120, bass side inner edge 124 and treble side inner edge 126 substantially follow an equal distance along peripheral edge 130 of tail end 106 of front plate 102 in exemplary embodiments. In embodiments where the stringed musical instrument has a curved tail end, such as what is commonly found in many guitars, cavity 118 is commonly in the shape of an inverted horseshoe such as the one shown in FIG. 2. In one embodiment, an inverted horseshoe shaped cavity has a straight neck-end edge 132 and a straight tail end edge 134.

In most embodiments, cavity 118 is shaped around a bridge support 136. Bridge support 136 is defined by neck end inner edge 122. In an exemplary embodiment, such as the one in FIG. 2, bridge support 136 is generally rectangular in shape. In other embodiments, bridge support 136 includes optional edge protrusions 138. Edge protrusions 138 may be rounded in shape. Two edge protrusions 138 exist in specific examples. Edge protrusions 138 may be on opposite sides of bridge support 136. Depending on the embodiment, the number of edge protrusions 138 varies. In one embodiment, edge protrusions 138 make bridge support 136 into a shape such that there is no cavity on the interior of front plate 102 below bridge 114.

In most embodiments, bridge 114 is mounted to front plate 102 over or on top of bridge support 136. Bridge support 136's support of bridge 114 provides additional stiffness and limits uncontrolled vibration of the bridge thereby reducing uncontrolled feedback. Bridge support 136 additionally provides added strength.

In an exemplary embodiment, tail end inner edge 120, neck end inner edge 122, bass side inner edge 124, and treble side inner edge 126 are slanted such that cavity 118 gradually increases in depth. In one embodiment, tail end inner edge 120, bass side inner edge 124, and treble side inner edge 126 are slanted and neck end inner edge 122 is vertical. In some instances, cavity 118 is a uniform depth and tail end inner edge 120, neck end inner edge 122, bass side inner edge 124, and treble side inner edge 126 are substantially vertical. In one embodiment, the depth of cavity 118 at the deepest point is 0.38 inch. In this embodiment, the widest depth of the solid portion of front plate 102 may be 0.75 inch. The widest depth of the solid portion of front plate 102 may be 0.25 inch in other embodiments. In yet other embodiments, the widest depth of the solid portion of front plate 102 may be between about 0.75 inch and 0.50 inch or between about 0.50 inch and 0.25 inch.

Much like the widest depth of the solid portion of front plate 102, the depth of cavity 118 is not meant to be limiting and cavity depths such as up to about 0.69 inch, 0.63 inch, 0.50 inch, and 0.25 inch as compared to the widest depth of the solid portion of front plate 102 are envisioned. Cavity depths ranging between about 0.69 inch and 0.63 inch, between 0.63 inch and 0.50 inch, between 0.50 inch and 0.25 inch, and less than 0.25 inch are also envisioned. In many embodiments, the depth of cavity 118 at the deepest point is fifty percent (50%) of the widest depth of the solid portion of front plate 102. In other embodiments, the depth of cavity 118 at the deepest point ranges between fifty percent (50%) and seventy-five percent (75%), seventy-five percent (75%) and ninety percent (90%), ninety percent (90%) and ninety-two percent (92%), or greater than ninety two percent (92%) of the widest depth of front plate 102. In one embodiment, the depth of cavity 118 at the deepest point is about ninety-two percent (92%) of the widest depth of front plate 102.

The skilled artisan understands that the overall depth of the stringed musical instrument is easily varied by varying the initial thickness of front plate 102 or back plate 150. For example, in one embodiment, the depth of back plate 150 is 1.63 inches. In another embodiment, the depth of back plate 150 is 1.19 inches. These back plate depths are exemplary only and the depth of back plate 150 can be varied to obtain the desired overall stringed musical instrument depth and sound.

In one embodiment, tail end inner edge 120, bass side inner edge 124, and a treble side inner edge 126 are about 1.20 inches from the peripheral edge 130 of tail end 106. In another embodiment, tail end inner edge 120, bass side inner edge 124, and a treble side inner edge 126 are about 1 inch from the peripheral edge 130 of tail end 106. The tail end inner edge 120, bass side inner edge 124, and a treble side inner edge 126 distance from the peripheral edge 130 in certain embodiments is about 5% of the total length or total width of front plate 102. In other embodiments, the tail end inner edge 120, bass side inner edge 124, and a treble side inner edge 126 distance from peripheral edge 130 ranges from about 3%, 4%, 6% or more than 6% of the length or width of front plate 102. Cavity 118 extends along longitudinal axis 128 to center axis 137 of the narrowest point of the stringed musical instrument. In some embodiments, cavity 118 extends along longitudinal axis 128 beyond center axis 137. Cavity 118 may extend in a range along longitudinal axis 128 beyond center axis 137 at a distance that is about 65%, 70%, 75%, 80%, 85%, 90%, or 95% of the total length of front plate 102.

Figure 3A:
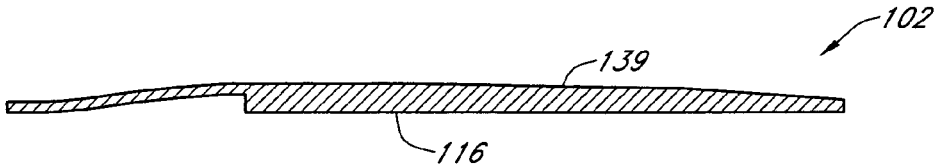
FIG. 3A demonstrates one embodiment of a cross-sectional view of the front plate.
Figure 3B:
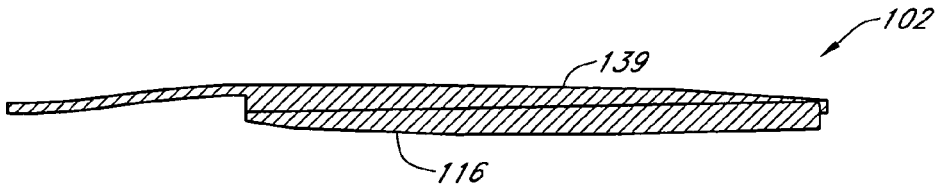
FIG. 3B demonstrates another embodiment of a cross-sectional view of the front plate.

In many embodiments, exterior 139 of front plate 102 is curved, such as is commonly known in the art. This curvature is demonstrated by the cross-section in FIG. 3A. FIG. 3A illustrates the non-cavity section of interior 116 of front plate 102 as flat; however, the non-cavity section of interior 116 of front plate 102 may also be curved such as represented in FIG. 3B. In exemplary embodiments, exterior 139 of front plate 102 is also carved. In one of these exemplary embodiments, this exterior carve results in a depth of about 0.18 inch at the narrowest depth of the solid portion of front plate 102 in tail end 106. In this same or a different embodiment, the exterior carve results in a depth of about 0.25 inch in the solid portion of front plate 102 in neck end 104. The depth and shape of the exterior carve is varied in other embodiments. For example, in some embodiments, the exterior carve results in a narrowest depth of about 0.25 inch in the solid portion of front plate 102 in neck end 104. The widest depth of the solid portion of front plate 102 is usually the portion encompassing bridge support 136.

Figure 4:
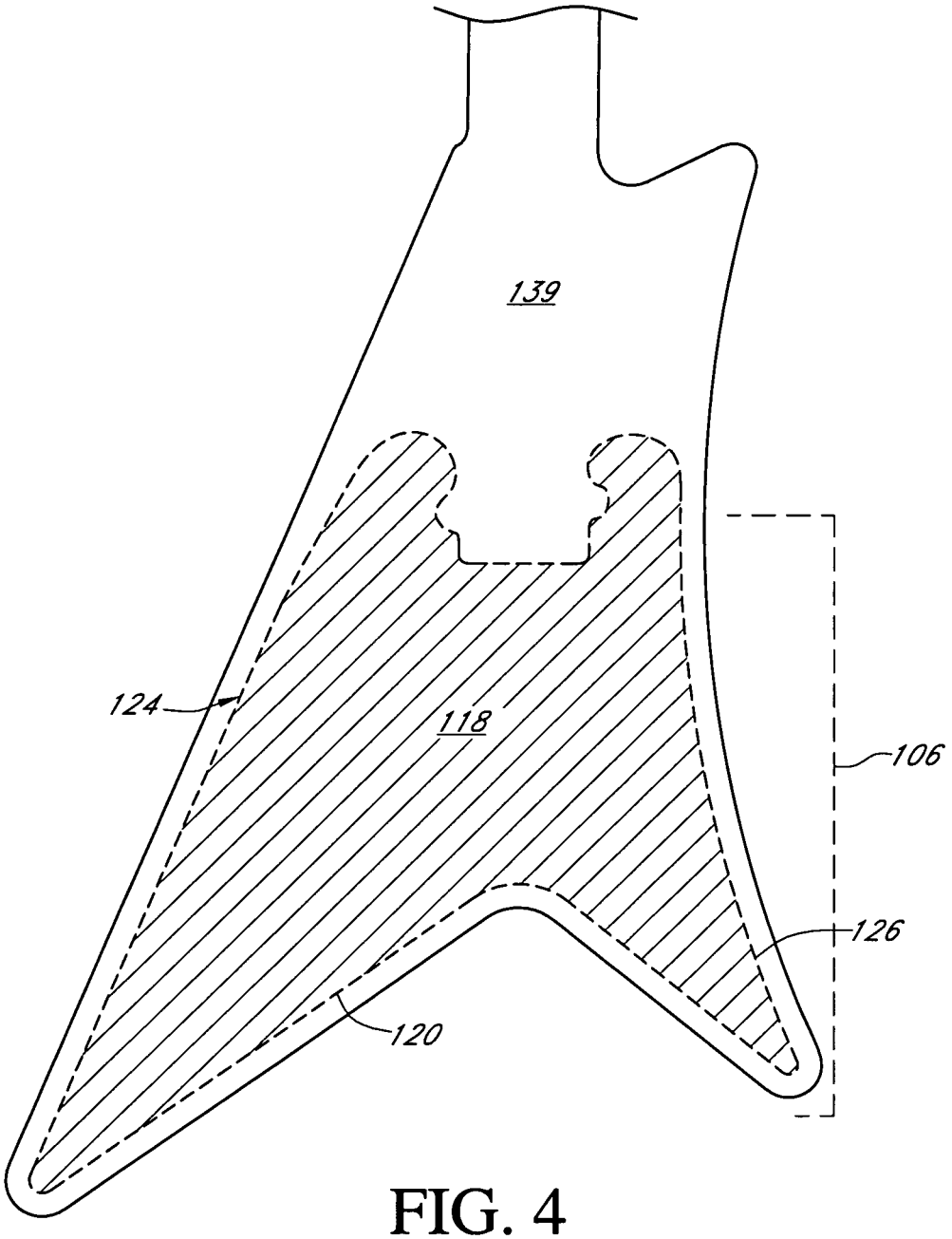
FIG. 4 is a front elevational view of a stringed musical instrument with a unique tail end shape.

In distinct embodiments, the stringed musical instrument has a dual triangular shaped cavity such as the one detailed in FIG. 4. However, even in these embodiments, the size and shape of cavity 118 is dependent upon the size and shape of tail end 106. In embodiments where tail end 106 is a shape different from a curve, tail end inner edge 120, bass side inner edge 124, and treble side inner edge 126 generally follow the shape of tail end 106. FIG. 4 illustrates cavity 118 in a dual triangular shape wherein neck end inner edge 122 is largely rectangular. U.S. Design Pat. No. D410,670 is an example of a stringed musical instrument requiring a cavity in a shape different than an inverted horseshoe.

Figure 5:
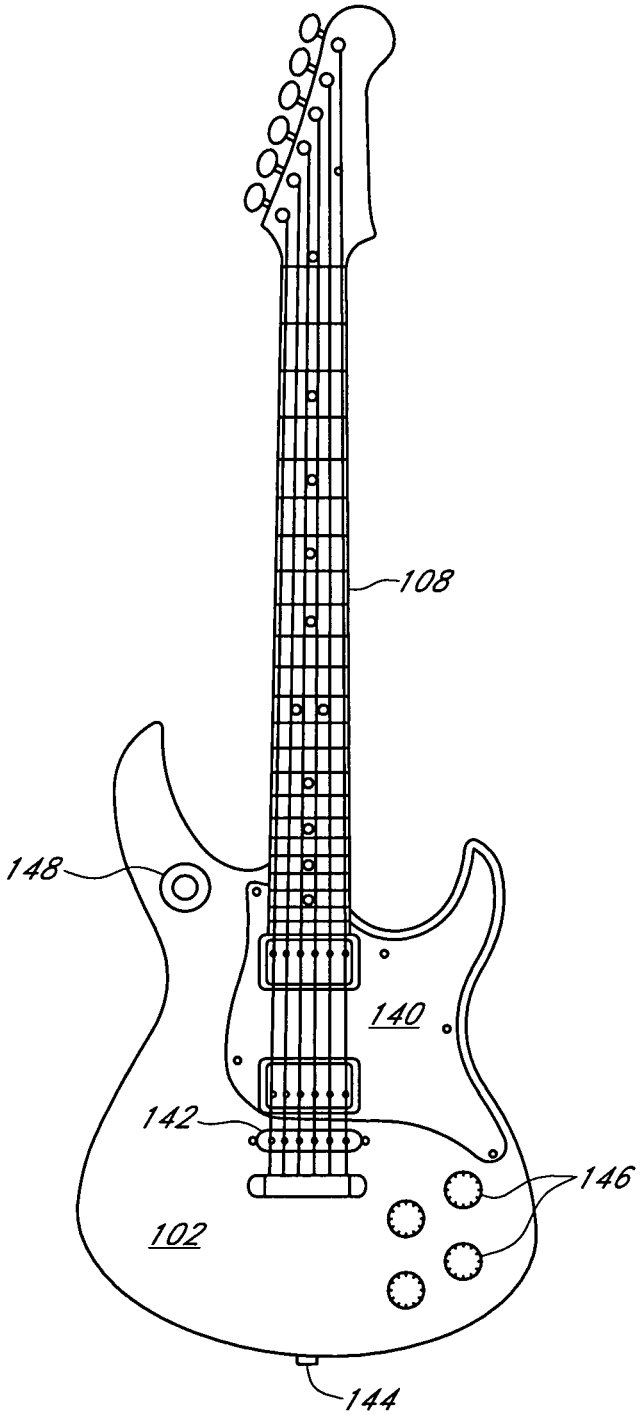
FIG. 5 is a front view of a guitar with a pick guard attached to the front plate.

Front plate 102 may additionally comprise a pick guard 140 such as the one shown in FIG. 5. Pick guard 140 may include a number of mounted electronic components, including one or more pickups 142, an audio jack 144, tone and volume controls 146, and if necessary, a pickup selector switch 148. These components are mounted in a conventional manner to pick guard 140. Pick guard 140 is mounted to front plate 102. In individual embodiments, pick guard 140 can be mounted via screws or some other method such as with magnets. In certain embodiments, electronic components, such as the ones listed above, are mounted directly to front plate 102. In many but not all cases, mounting of electrical components requires holes be placed in front plate 102. Electrical components may also be mounted within cavity 118. Sound holes and f-holes are also contemplated. Sound holes are well known in the art and not meant to be limiting either in shape or number.

Figure 7:
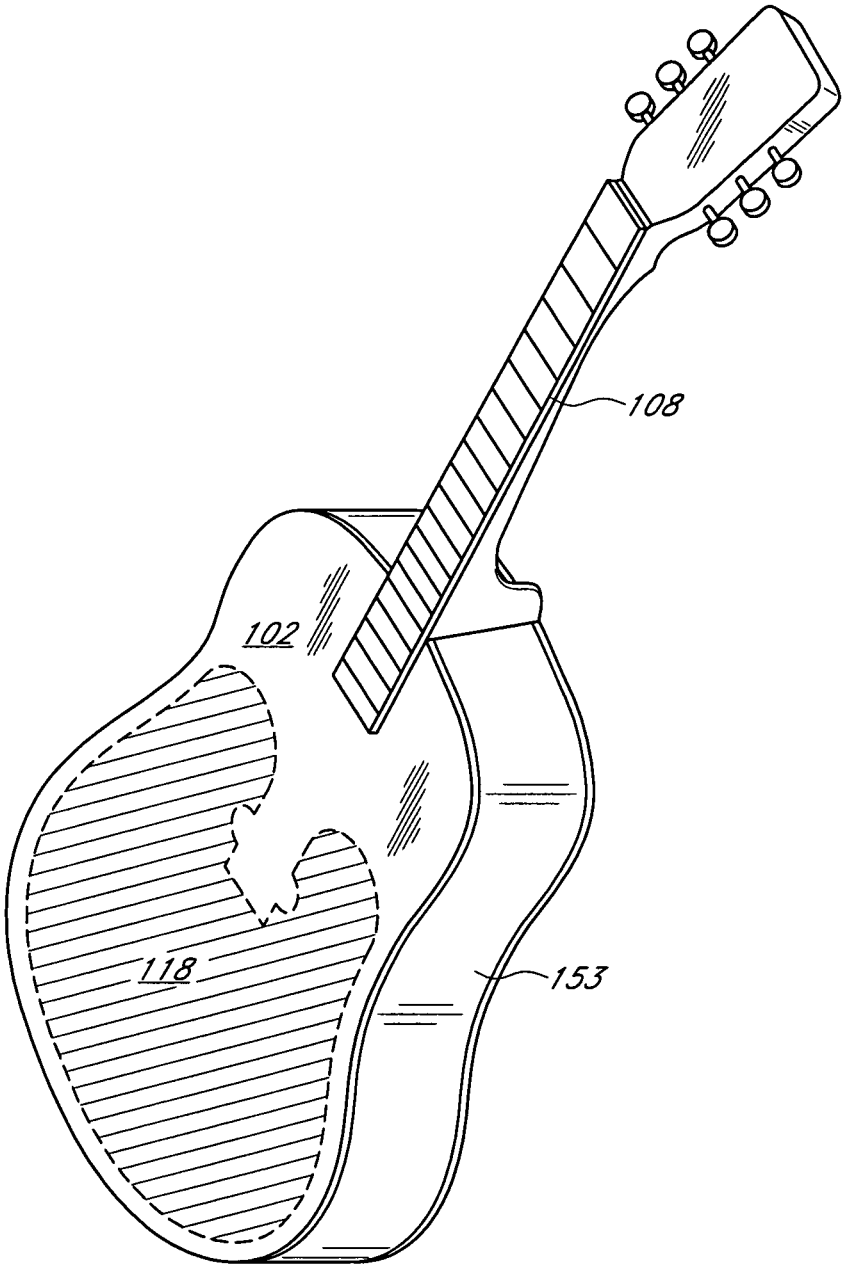
FIG. 7 shows a stringed musical instrument where the front plate and back plate are connected through a sidewall.

Shapes of the neck end 104 of body 100 are not limiting. Various neck end shapes may be chosen based on aesthetics and desired comfort and sound. Several different neck end shapes are demonstrated by FIGS. 1, 4 and 7. Non-limiting example neck end shapes include those displayed in U.S. Design Pat. Nos. D548,771; D407,430; D405,459; and D392,310.

Figure 6:
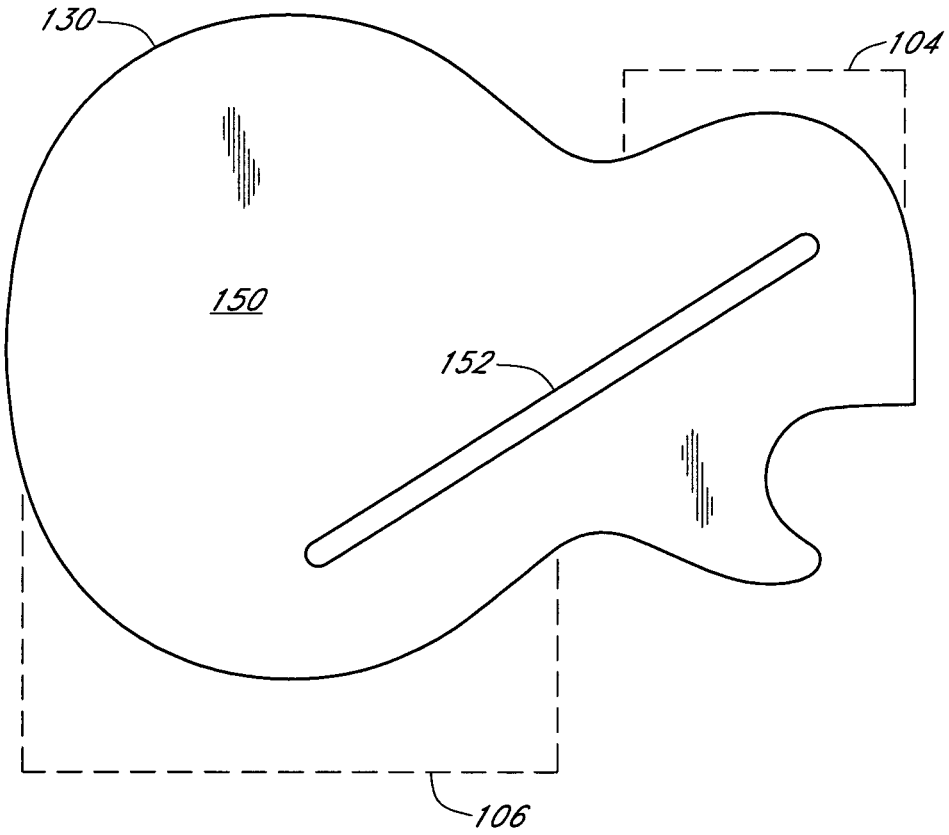
FIG. 6 illustrates a back plate of the stringed musical instrument.

The stringed musical instruments also include at least one back plate 150. Back plate 150, demonstrated by FIG. 6 is generally a flat piece of material with the same perimeter shape as front plate 102. However, in some embodiments, back plate 150 will also contain a cavity. Cavities in back plates of stringed musical instruments are well known and not met to be limiting. In certain embodiments, back plate 150 includes a channel 152 for wiring of electronic components.

Back plate 150 and front plate 102 may be attached to each other by a variety of ways, all of which are well known in the art. These include lamination, adhesive, and physical attachment, i.e. such as with bolts or other threaded inserts. Certain embodiments, such as the one demonstrated in FIG. 7, further incorporate sidewalls 153 connected directly to front plate 102 and back plate 150 such as to connect the front plate and back plate. Stringed musical instrument sidewalls are well known in the art and not meant to be limiting.

Once back plate 150 and front plate 102 are attached, cavity 118 becomes part of a resonance chamber within the stringed musical instrument. The interior 154 of back plate 150 and the interior 116 of front plate 102 define the boundaries of the resonance chamber. If back plate 150 is a flat piece of material and back plate 150 and front plate 102 connect directly to each other, the size of the resonance chamber is the shape and depth of cavity 118. If back plate 150 and front plate 102 are connected through a sidewall 153 such as in the example illustrated by FIG. 7, the resonance chamber may include space in addition to cavity 118. For example, in this embodiment, the resonance chamber, in addition to the shape of cavity 118 includes space in the overall shape of body 100 with a thickness of the height of sidewall 153. The height of sidewall 153 is varied between the front plate 102 and back plate 150 to increase or decrease the size of the resonance chamber. A resonance chamber may also include cavities in back plate 150. As the skilled artisan understands, varying the size and shape of the resonance chamber through variations of cavity 118, variations in cavities in back plate 150, as well as the attachment of front plate 102 and back plate 150 varies the resonance and sustainability of the sound created when plucking or strumming a string attached to the stringed musical instrument. It should be understood that adjustment of the resonant characteristics of the stringed musical instrument may be accomplished with very little effect on the external appearance. Although generally the stringed musical instrument will contain only a single resonance chamber, in some embodiments there may be 2, 3, or more resonance chambers.

In many embodiments, the material used to make the stringed musical instruments is wood. The type of wood is not meant to be limiting but as is well understood by the skilled artisan, the type of wood used can alter the sound and appearance of the instrument. Examples of the types of wood that may be used to construct the stringed musical instruments include, but are not limited to, alder, ash, cedar, spruce, basswood, mahogany, maple, and poplar. There is no requirement that the type of wood be the same between front plate 102 and back plate 150. Nor is there a requirement that the type of wood be the same between front plate 102 and any other piece of the stringed musical instrument.

In other embodiments, the stringed musical instruments are made from composite laminate materials such as graphite or phenolic laminate. Stringed musical instruments constructed from graphite are disclosed in U.S. Pat. No. 5,333,527, which is hereby incorporated by reference.

Commonly, front plate 102 and back plate 150 will each be made from a single piece of material. Nevertheless, embodiments where either front plate 102 or back plate 150 or both are made from numerous pieces of material are envisioned. For example, front plate 102 may be a composite made from 2, 3, 4, 5, or more pieces of material. Each of these pieces may be either a single type or different type of material.

To make the disclosed stringed musical instrument body, the shape of body 100 is determined. Once the shape has been determined, front plate 102 is constructed in the desired overall shape. Cavity 118 of the desired shape and depth is generally carved into front plate 102 either before or after the overall shape of front plate 102 has been constructed. Following the construction of cavity 118, back plate 150 is connected with front plate 102. In many embodiments, back plate 150 is connected with front plate 102 prior to back plate 150 being constructed into a desired shape. The exterior of front plate 102 may also be carved. The exterior of front plate 102 may be carved before or after front plate 102 is attached to back plate 150. The exterior of front plate 102 may also be carved either before or after the overall shape of front plate 102 has been constructed.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A body for a stringed musical instrument comprising:

a wooden front plate having an exterior and an interior, wherein the interior comprises a tail end inner edge, a neck end inner edge, a bass side inner edge, and a treble side inner edge, further wherein the tail end inner edge, neck end inner edge, bass side inner edge and treble side inner edge define an integral cavity, and a back plate, wherein the integral cavity and the back plate cooperate to form a resonance chamber.

2. The body of claim 1 wherein the resonance chamber is an inverted horseshoe shape.

3. The body of claim 2 wherein the tail end inner edge, neck end inner edge, bass side inner edge, and treble side inner edge are slanted such that the integral cavity gradually increases in depth.

4. The body of claim 2 wherein the tail end inner edge, neck end inner edge, bass side inner edge, and treble side inner edge are straight such that the integral cavity is uniform in depth.

5. The body of claim 1 further wherein the neck end inner edge defines a bridge support.

6. The body of claim 5 wherein the bridge support comprises at least one edge protrusion.

7. The body of claim 6 wherein the edge protrusion is rounded in shape.

8. The body of claim 1 wherein the integral cavity extends from the tail end inner edge to a center axis of the front plate.

9. The body of claim 1 further comprising a sidewall.

10. The body of claim 1 wherein the exterior of the front plate is curved.

11. The body of claim 1 wherein the resonance chamber is symmetrical around a longitudinal axis.

12. The body of claim 1 wherein the front plate comprises a single piece of material.

13. The body of claim 1 wherein a maximum depth of the integral cavity is greater than fifty percent (50%) of a maximum depth of the front plate.

14. The body of claim 1 wherein a narrowest depth of a solid portion of the front plate is about 0.18 inch.

15. The body of claim 1 wherein a widest depth of a solid portion of the front plate is about 0.75 inch.

16. The body of claim 1 wherein the front plate comprises maple.

17. A stringed musical instrument comprising:

a body having a wooden front plate with an exterior and an interior, wherein the interior of the front plate comprises a tail end inner edge, a neck end inner edge, a bass side inner edge, and a treble side inner edge, further wherein the tail end inner edge, neck end inner edge, bass side inner edge and treble side inner edge define an integral cavity and a back plate, wherein the integral cavity and the back plate cooperate to form a resonance chamber;

a neck attached with the body, the neck configured to receive at least one string at a first end; and a bridge fitted with the front plate, the bridge configured to receive at least one string at a second end opposite the first end, wherein the at least one string is extended over at least a portion of the neck and the body.

18. A method of constructing a body for a stringed musical instrument, comprising the steps of:

constructing an integral cavity in an interior of a wooden front plate, wherein the integral cavity is defined by a tail end inner edge, a neck end inner edge, a bass side inner edge, and a treble side inner edge; and attaching a back plate to the constructed front plate such that the integral cavity and the back plate cooperate to form a resonance chamber.

* * * * *